US011728593B2

(12) United States Patent
Yen

(10) Patent No.: US 11,728,593 B2
(45) Date of Patent: Aug. 15, 2023

(54) HIGH-FREQUENCY ELECTRICAL CONNECTOR

(71) Applicant: CHANT SINCERE CO., LTD., New Taipei (TW)

(72) Inventor: Ming-Hui Yen, New Taipei (TW)

(73) Assignee: CHANT SINCERE CO., LTD., New Taipei (TW)

( * ) Notice: Subject to any disclaimer, the term of this patent is extended or adjusted under 35 U.S.C. 154(b) by 4 days.

(21) Appl. No.: 17/475,353

(22) Filed: Sep. 15, 2021

(65) Prior Publication Data

US 2022/0416476 A1 Dec. 29, 2022

(30) Foreign Application Priority Data

Jun. 25, 2021 (TW) ..... 110207444

(51) Int. Cl.

| | |
|---|---|
| ***H01R 13/6471*** | (2011.01) |
| ***H01R 13/40*** | (2006.01) |
| ***H01R 13/629*** | (2006.01) |
| ***H01R 13/6582*** | (2011.01) |
| ***H01R 24/60*** | (2011.01) |

(52) U.S. Cl.

CPC ..... *H01R 13/6471* (2013.01); *H01R 13/40* (2013.01); *H01R 13/629* (2013.01); *H01R 13/6582* (2013.01); *H01R 24/60* (2013.01)

(58) Field of Classification Search

CPC .... H01R 24/60; H01R 13/6597; H01R 13/40; H01R 13/629; H01R 13/502; H01R 13/516; H01R 13/6471; H01R 13/652; H01R 13/6582; H01R 13/6591; H01R 13/6594; H01R 12/721; H01R 12/722; H01R 12/724; H01R 12/727; H01R 12/73; H01R 12/732

See application file for complete search history.

(56) References Cited

U.S. PATENT DOCUMENTS 6,089,882 A * 7/2000 Costello ..... H01R 13/6583 439/95
8,292,630 B1 * 10/2012 Bobuk ..... H01R 12/73 439/74
8,864,506 B2 * 10/2014 Little ..... H01R 13/658 439/108

(Continued)

FOREIGN PATENT DOCUMENTS

CN 110504594 A * 11/2019 ..... H01R 13/02

*Primary Examiner* — Marcus E Harcum

(57) ABSTRACT

An electrical connector, comprising a plurality of first terminals, a plurality of second terminals, and a partitioning member. The plurality of first terminals comprise at least one pair of first differential signal terminals and at least one first ground terminal. The plurality of second terminals comprise at least a pair of second differential signal terminals. The partitioning member is disposed between the first terminals and the second terminals. The partitioning member is grounded and comprises a partitioning member body and at least one first bump. The first bump is disposed at the partitioning member body. The partitioning member body is at least disposed between the pair of first differential signal terminals and the pair of second differential signal terminals to shield the pair of first differential signal terminals and the pair of second differential signal terminals. The first bump is electrically connected with the at least one first ground terminal.

9 Claims, 7 Drawing Sheets

(56) References Cited

U.S. PATENT DOCUMENTS

| | | | | |
|---|---|---|---|---|
| 9,178,319 | B2 * | 11/2015 | Little | H01R 13/6585 |
| 9,444,204 | B2 * | 9/2016 | Yen | H01R 24/78 |
| 9,496,653 | B2 * | 11/2016 | Little | H01R 13/6582 |
| 9,634,437 | B2 * | 4/2017 | Kao | H01R 13/6461 |
| 9,666,996 | B2 * | 5/2017 | Hsu | H01R 13/6585 |
| 9,825,407 | B2 * | 11/2017 | Wu | H01R 12/53 |
| 9,979,145 | B2 * | 5/2018 | Wu | H01R 13/6591 |
| 9,997,853 | B2 * | 6/2018 | Little | H01R 13/6471 |
| 10,062,989 | B2 * | 8/2018 | Little | H01R 13/6582 |
| 10,333,243 | B2 * | 6/2019 | Tang | H01R 12/7011 |
| 10,367,313 | B2 * | 7/2019 | Wu | H01R 13/6585 |
| 10,381,776 | B2 * | 8/2019 | Wu | H01R 13/665 |
| 10,396,499 | B1 * | 8/2019 | Shen | H01R 13/6594 |
| 10,403,991 | B2 * | 9/2019 | Takeuchi | H01R 13/6275 |
| 10,411,408 | B2 * | 9/2019 | Wu | H01R 13/6272 |
| 10,439,332 | B2 * | 10/2019 | Ju | H01R 13/6581 |
| 10,673,159 | B2 * | 6/2020 | Ishida | H01R 12/721 |
| 10,777,952 | B2 * | 9/2020 | Chien | H01R 13/6581 |
| 10,811,824 | B2 * | 10/2020 | Teruki | H01R 12/716 |
| 2010/0210124 | A1 * | 8/2010 | Li | H01R 12/724 439/108 |
| 2016/0156136 | A1 * | 6/2016 | Kao | H01R 13/6585 439/607.05 |
| 2017/0077651 | A1 * | 3/2017 | Chang | H01R 24/64 |
| 2021/0384679 | A1 * | 12/2021 | Liao | H01R 12/51 |

* cited by examiner

HIGH-FREQUENCY ELECTRICAL CONNECTOR

CROSS-REFERENCE TO RELATED APPLICATION

This application claims the priority benefit of Taiwanese Patent Application Serial Number TW110207444, filed on Jun. 25, 2021, the full disclosure of which is incorporated herein by reference.

BACKGROUND

Technical Field

The present disclosure relates to the technical field of electrical connectors, particularly to an electrical connector for improving the high frequency signals transmission performance by overlapping the partitioning member between the upper and lower terminals with the grounding terminal between the upper and lower terminal.

Related Art

With the development of communication technology, requirements for the data transmission rate in electronic devices are greatly increased, and the design for electrical connectors forming electrical connections between electronic devices to transmit signals needs to be a high speed transmission performer. For example, conventional USB type C electrical connectors are equipped with two high frequency differential signal pairs among the twelve terminals in the upper row of the connector and two high frequency differential signal pairs among the twelve terminals in the lower row of the connector. When transmitting, high frequency signals are accompanied by electromagnetic wave radiation to crosstalk with the transmission of other high frequency signals nearby.

With respect to the crosstalk during high frequency signal transmitting, in the upper row terminals of the USB type C electrical connector, in addition to the ground terminals at two ends, the Vbus terminal can be grounded, so that the ground terminals and the Vbus terminal could perform shielding between the two pairs of differential signals pairs among of the upper row terminals. In the lower row terminals, the Vbus terminal can also be grounded to allow the ground terminals and the Vbus terminal to perform shielding between the two pairs of differential signals pairs among of the upper row terminals.

Crosstalk affecting signal transmission would also occur between the differential signal terminal pairs of the upper row terminals and the lower row of terminals in conventional electrical connectors.

SUMMARY

The embodiments of the present disclosure provide an electrical connector tended to solve the problem of crosstalk between the differential signal terminal pairs of the upper row terminals and the lower row terminals to further improve high frequency signal transmission.

The present disclosure provides an electrical connector, comprising a metal housing, a first insulating base, a plurality of first terminals, a second insulating base, a plurality of second terminals, and a partitioning member. The metal housing comprises a mating interface. The first insulating base is disposed in the metal housing. The plurality of first terminals are disposed at the first insulating base and comprise at least one pair of first differential signal terminals and at least one first ground terminal. The second insulating base is disposed in the metal housing and is assembled to the first insulating base. The plurality of second terminals are disposed at the second insulating base and comprise at least a pair of second differential signal terminals. The partitioning member is disposed between the first insulating base and the second insulating base and between the first terminals and the second terminals. The partitioning member is grounded and comprises a partitioning member body and at least one first bump. The first bump is disposed at the partitioning member body. The partitioning member body is at least disposed between the pair of first differential signal terminals and the pair of second differential signal terminals to shield the pair of first differential signal terminals and the pair of second differential signal terminals. The first bump is electrically connected with the at least one first ground terminal.

In the embodiments of the present disclosure, by disposing a partitioning member between the plurality of first terminals and the plurality of second terminals of the electrical connector, and particularly between a pair of first differential signal terminals and a pair of second differential signal terminals, shielding effects could be provided for the pair of first differential signal terminals and the pair of second differential signal terminals.

Besides, since the partitioning member is electrically connected with the first ground terminal through the first bump, when the electromagnetic wave generated by the pair of first differential signal terminals and the pair of second differential signal terminals during signal transmission is absorbed by the partitioning member, it would be conducted out of the device through the ground circuit formed by the electrical connection between the first bump of the partitioning member and the ground terminal to enhance the shielding performance of the partitioning member and to improve the signal transmission rate of the pair of first differential signal terminals and the pair of second differential signal terminals.

It should be understood, however, that this summary may not contain all aspects and embodiments of the present disclosure, that this summary is not meant to be limiting or restrictive in any manner, and that the disclosure as disclosed herein will be understood by one of ordinary skill in the art to encompass obvious improvements and modifications thereto.

BRIEF DESCRIPTION OF THE DRAWINGS

The features of the exemplary embodiments believed to be novel and the elements and/or the steps characteristic of the exemplary embodiments are set forth with particularity in the appended claims. The Figures are for illustration purposes only and are not drawn to scale. The exemplary embodiments, both as to organization and method of operation, may best be understood by reference to the detailed description which follows taken in conjunction with the accompanying drawings in which:

DETAILED DESCRIPTION OF THE EMBODIMENTS

The present disclosure will now be described more fully hereinafter with reference to the accompanying drawings, in which exemplary embodiments of the disclosure are shown. This present disclosure may, however, be embodied in many different forms and should not be construed as limited to the embodiments set forth herein. Rather, these embodiments are provided so that this present disclosure will be thorough and complete, and will fully convey the scope of the present disclosure to those skilled in the art.

Certain terms are used throughout the description and following claims to refer to particular components. As one skilled in the art will appreciate, manufacturers may refer to a component by different names. This document does not intend to distinguish between components that differ in name but function. In the following description and in the claims, the terms "include/including" and "comprise/comprising" are used in an open-ended fashion, and thus should be interpreted as "including but not limited to". "Substantial/substantially" means, within an acceptable error range, the person skilled in the art may solve the technical problem in a certain error range to achieve the basic technical effect.

The following description is of the best-contemplated mode of carrying out the disclosure. This description is made for the purpose of illustration of the general principles of the disclosure and should not be taken in a limiting sense. The scope of the disclosure is best determined by reference to the appended claims.

Moreover, the terms "include", "contain", and any variation thereof are intended to cover a non-exclusive inclusion. Therefore, a process, method, object, or device that includes a series of elements not only includes these elements, but also includes other elements not specified expressly, or may include inherent elements of the process, method, object, or device. If no more limitations are made, an element limited by "include a/an . . . " does not exclude other same elements existing in the process, the method, the article, or the device which includes the element.

Figure 1:
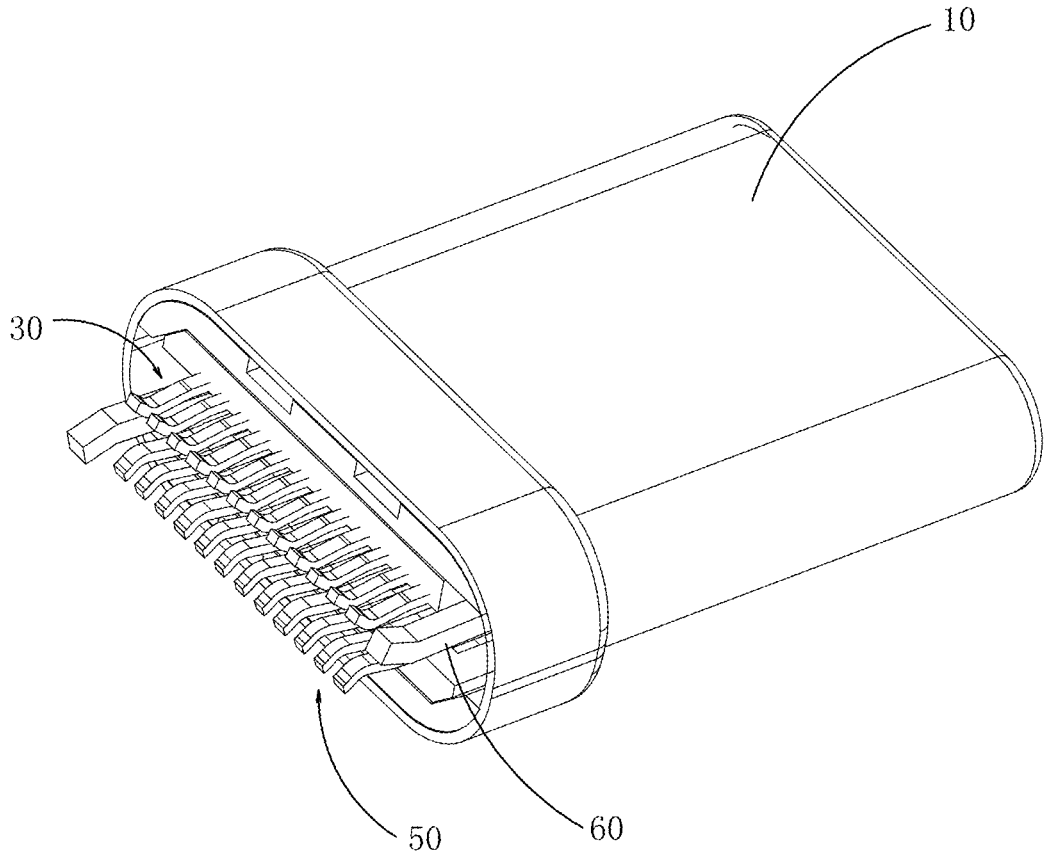
FIG. 1 is a perspective view of an electrical connector of an embodiment of the present disclosure.
Figure 2:
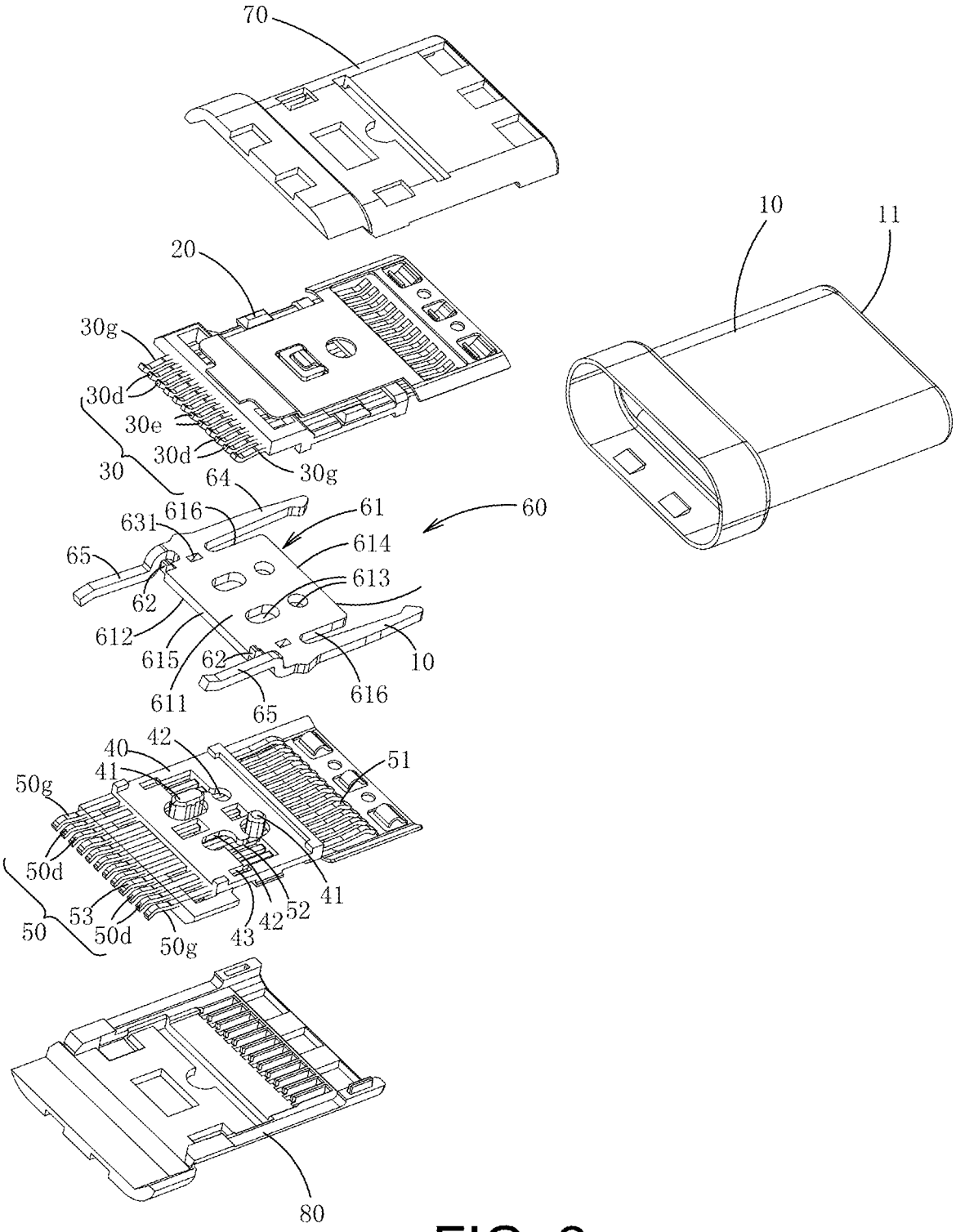
FIG. 2 is an exploded view of the electrical connector of FIG. 1.
Figure 3:
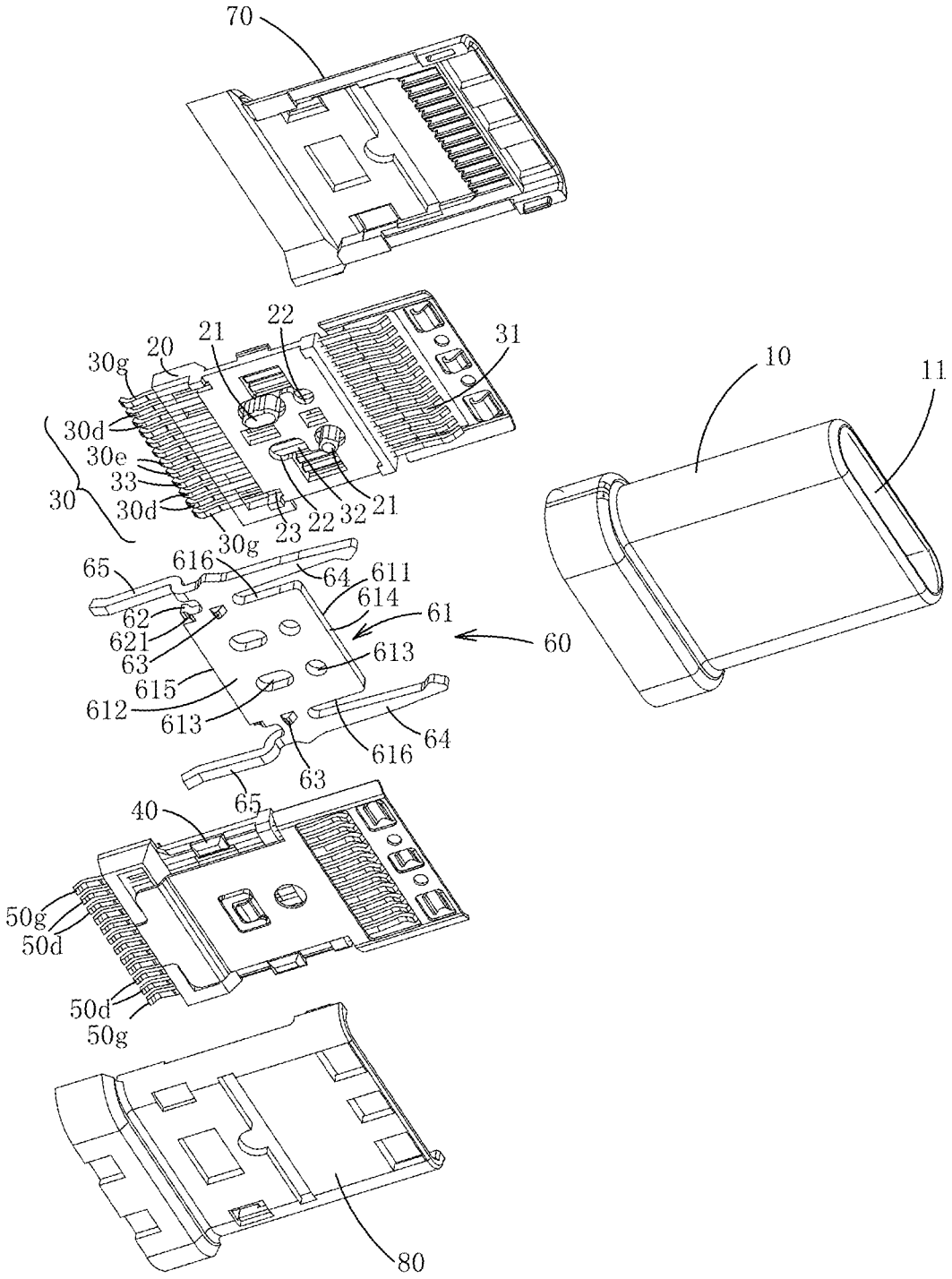
FIG. 3 is another exploded view of the electrical connector of FIG. 1.

FIG. 1 is a perspective view of an electrical connector of an embodiment of the present disclosure. FIG. 2 and FIG. 3 are exploded views of the electrical connector of FIG. 1. As shown in the figures, in this embodiment, an electrical connector of a USB type C is taken as an example for description, but the connector type of the present disclosure is not limited thereto, other types of connectors having different specifications are also applicable.

The electrical connector of this embodiment comprises a metal housing 10, a first insulating base 20, a plurality of first terminals 30, a second insulating base 40, a plurality of second terminals 50, and a partitioning member 60. The plurality of first terminals 30 are arranged in a row and are combined with the first insulating base 20 by insert molding and positioned in the first insulating base 20. Each of the first terminals 30 comprises a first elastic press-fitting part 31 elastically press-fitted with a terminal or contacting point of a mating electrical connector, a first coupling part 32 coupled with the first insulating base 20, and a first soldering part 33 which is exposed from the first insulating base 20 and is soldered to a circuit board. The plurality of second terminals 50 are arranged in a row, and are combined with the second insulating base 40 by embedding-injection molding and positioned in the second insulating base 40. Each of the second terminals 50 comprises a second elastic press-fitting part 51 elastically press-fitted with a terminal or contacting point of a mating electrical connector, a second coupling part 52 coupled with the second insulating base 40, and a second soldering part 53 which is exposed from the second insulating base 40 and is soldered to a circuit board. The first insulating base 20 is combined with and stacked with the second insulating base 40 so that the rows of the terminal of the plurality of first terminals 30 are arranged in parallel to and stacked with the rows of the terminal of the plurality of second terminals 50.

The first insulating base 20 comprises a plurality of first engaging columns 21 and a plurality of first engaging holes 22, which are alternately arranged. The second insulating base 40 comprises a plurality of second engaging columns 41 and a plurality of second engaging holes 42, which are alternately arranged. The first engaging column 21 corresponds to the second engaging hole 42, and the first engaging hole 22 corresponds to the second engaging column 41. The first engaging column 21 is engaged with the second engaging hole 42 and the second engaging column 41 is engaged with the first engaging hole 22 so that the first insulating base 20 can be assembled to the second insulating base 40. In this embodiment, the electrical connector further comprises a first insulating housing 70 and a second insulating housing 80. When the first insulating base 20 is assembled to the second insulating base 40, the first insulating housing 70 would be assembled to the first insulating base 20 and cover the first elastic press-fitting part 31 of the first terminal 30, and the second insulating housing 80 would be assembled to the second insulating base 40 and cover the second elastic press-fitting part 51 of the second terminal 50. The metal housing 10 is sleeved on the outer side of the first insulating housing 70 and the outer side of the second insulating housing 80. The metal housing 10 comprises a mating interface 11 for being plugged into a mating electrical connector. A circuit board (not shown) is disposed behind the electrical connector of the present disclosure, the first soldering part 33 of the first terminal 30 and the second soldering part 53 of the second terminal 50 are soldered to a solder pad on a circuit board, and a core wire of a cable is soldered to a solder pad on the other end of the circuit board. In this way, the first terminal 30 and the second terminal 50 of the electrical connector could be electrically connected to the core wire of the cable.

Taking a USB type C electrical connector as an example, to realize the insertion from both upper and lower directions, the number of first terminals 30 in the upper row is the same as the number of second terminals 50 in the lower row and arranging orders of the terminals having different functions are arranged reversely. The upper row is provided with twelve first terminals 30 (A1 to A12), and the lower row is provided with twelve second terminals 50 (B1 to B12). Among the first terminals 30 in the upper row, the first terminals 30 at two ends are first ground terminals 30*g* (A1 and A12). Among the second terminals 50 in the lower row, the second terminals 50 at two ends are second ground terminals 50*g* (B1 and B12). The first terminal 30 in the upper row comprises two pairs of first differential signal terminals 30*d* (A2 and A3, A10 and A11) for transmitting high frequency signals and a pair of differential signal terminals 30*e* (A6 and A7) for transmitting common signals.

The second terminal 50 in the lower row comprises two pairs of second differential signal terminals 50*d* (B2 and B3, B10 and B11) for transmitting high frequency signals.

The partitioning member 60 is disposed between the first insulating base 20 and the second insulating base 40 and between the plurality of first terminals 30 and the plurality of second terminals 50. The partitioning member 60 is a metal plate-shaped member manufactured by stamping, which comprises a partitioning member body 61, a first bump 62, and a second bump 63.

Figure 4:
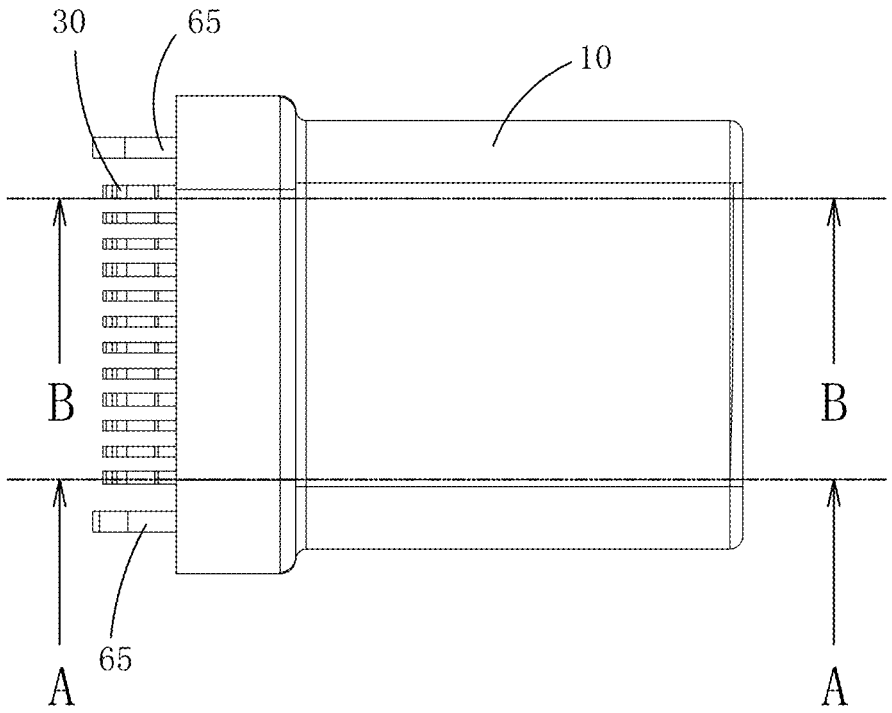
FIG. 4 is a top view of the electrical connector of FIG. 1.
Figure 5:
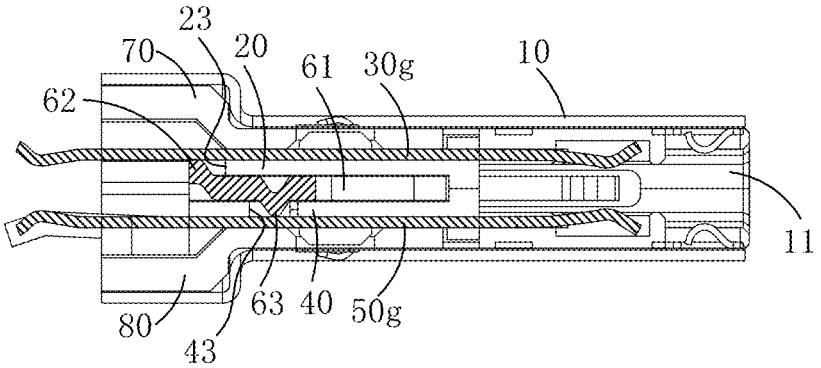
FIG. 5 is a cross-sectional view along line A-A of FIG. 4.
Figure 6:
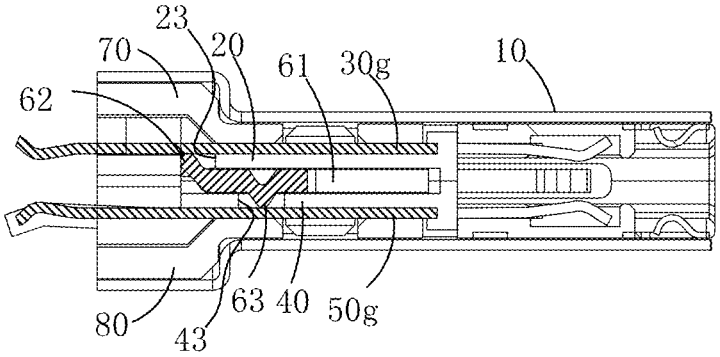
FIG. 6 is a cross-sectional view along line B-B of FIG. 4.

As shown in FIG. 4, FIG. 5, and FIG. 6, the partitioning member body 61 is a rectangular plate, which comprises a first surface 611 and a second surface 612. The first surface 611 is opposite to the second surface 612. The first surface 611 corresponds to the first terminal 30, and the second surface 612 corresponds to the second terminal 50. The first bump 62 protrudes from the first surface 611 and abuts against the first ground terminal 30*g* of the first terminal 30 (A1 and A12 of the first terminal 30 in the upper row). The number of first bumps 62 could correspond to the number of ground terminals of the first terminal 30. The second bump 63 protrudes from the second surface 612 and abuts against the second ground terminal 50*g* of the second terminal 50 (B1 and B12 in the second terminal 50 in the lower row). Since the first insulating base 20 is disposed between the first terminal 30 and the partitioning member 60, the first insulating base 20 is provided with a first through groove 23, and the first bump 62 passes through the first through groove 23 and abuts against the first ground terminal 30*g*. Similarly, since the second insulating base 40 is disposed between the second terminal 50 and the partitioning member 60, the second insulating base 40 is provided with a second through groove 43, and the second bump 63 passes through the second through groove 43 and abuts against the second ground terminal 50*g*.

Besides, the partitioning member body 61 is disposed between the first differential signal terminal 30*d* (A2 and A3, A10 and A11) of the upper row of the first terminal 30 and the second differential signal terminal 50*d* (B2 and B3, B10 and B11) of the lower row of second terminals 50 to perform electromagnetic shielding to the first differential signal terminal 30*d* of the first terminal 30 in the upper row and the second differential signal terminal 50*d* of the second terminal 50 in the lower row. The electromagnetic waves generated during the first differential signal terminal 30*d* of the first terminal 30 in the upper row and the second differential signal terminal 50*d* of the second terminal 50 in the lower row transmitting high frequency signals is absorbed by the first ground terminal 30*g* and the second ground terminal 50*g* along the direction in which the first terminal 30 and the second terminal 50 are arranged, and the partitioning member body 61 absorbs the electromagnetic waves transmitted in the vertical direction to achieve electromagnetic shielding.

The partitioning member body 61 is provided with a plurality of mounting holes 613, through which the first engaging column 21 of the first insulating base 20 and the second engaging column 41 of the second insulating base 40 are passing. By the first engaging column 21 being engaged with the second engaging hole 42 and the second engaging column 41 being engaged with the first engaging hole 22 assembled on the first insulating base 20 and the second insulating base 40, the partitioning member 60 can be held and positioned between the first insulating base 20 and the second insulating base 40. To avoid affecting the electromagnetic shielding, the mounting hole 613 should not be provided on the positions of the differential terminal pairs of the first terminal 30 and the second terminal 50.

The partitioning member body 61 comprises a front edge 614 close to a mating interface 11 of the metal housing 10, a rear edge 615 away from the mating interface 11 of the metal housing 10, and a side edge 616 on the side and connecting with the front edge 614 and the rear edge 615. In this embodiment, the first bump 62 is disposed at a position connecting the rear edge 615 and the side edge 616, and the first bump 62 is a block. The second bump 63 is disposed close to the side edge 616 and is a toothed bump. The second bump 63 and the first bump 62 are arranged along an extending direction of the first terminal 30 and the second terminal 50. Since the first bump 62 and the second bump 63 are punched into a bump shape at a specific position of the partitioning member body 61, a first recess 631 is formed at a position on the first surface 611 corresponding to the second bump 63, and a second recess 621 is formed at a position on the second surface 612 corresponding to the first bump 62.

The partitioning member 60 further comprises a pair of buckling parts 64, which are rod shaped and are disposed on the side edge 616 of the partitioning member body 61. The buckling parts 64 extends in a direction toward the mating interface 11 of the metal housing 10. In the present disclosure, when the electrical connector is plugged into a mating electrical connector, the buckling parts 64 could clamp the mating connector to enhance the reliability of the plugging.

The partitioning member 60 further comprises a pair of ground end parts 65, which are rod shaped and disposed on the side edge 616 of the partitioning member body 61. In this embodiment, the ground end part 65 is connected to the buckling part 64 and extends in a direction away from the mating interface 11 of the metal housing 10. That is, the ground end part 65 extends in a direction toward a circuit board and can be overlapped or soldered to the circuit board, and further to be grounded through the electrical connection of the circuit board and the core wire with a grounding part of an electronic device.

Since the first bump 62 of the partitioning member 60 is electrically connected with the first ground terminal 30*g* of the first terminal 30, and the second bump 63 of the partitioning member 60 is electrically connected with the second ground terminal 50*g* of the second terminal 50, the electromagnetic wave energy absorbed by the first ground terminal 30*g* and the second ground terminal 50*g* during electromagnetic shielding can be introduced to the grounding part through the grounding path of the partitioning member 60 to improve the electromagnetic shielding performance of the first ground terminal 30*g* and the second ground terminal 50*g*, thereby the strength of the high frequency signal transmitted by each pair of differential terminals can be enhanced.

Figure 7:
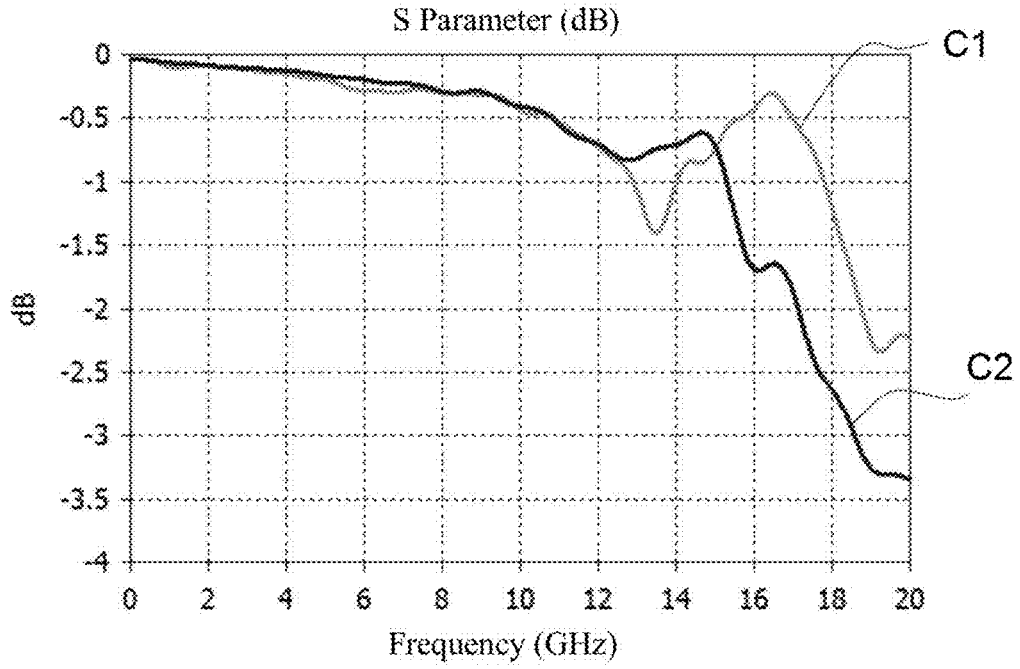
FIG. 7 is a test curve of insertion loss and frequency of conventional electrical connectors and the electrical connector of the present disclosure.

FIG. 7 shows the comparison of insertion loss of conventional electrical connectors and the electrical connector of the present disclosure. Curve C1 corresponds to a conventional electrical connector, and curve C2 corresponds to the electrical connector of the present disclosure. An obvious signal attenuation occurs at the frequency of 13 GHz for a conventional electrical connector, while the insertion loss at the frequency of 13 GHz is significantly improved as the first bump and the second bump are electrically connected to the first ground terminal and the second ground terminal for the electrical connector of the present disclosure.

Figure 8:
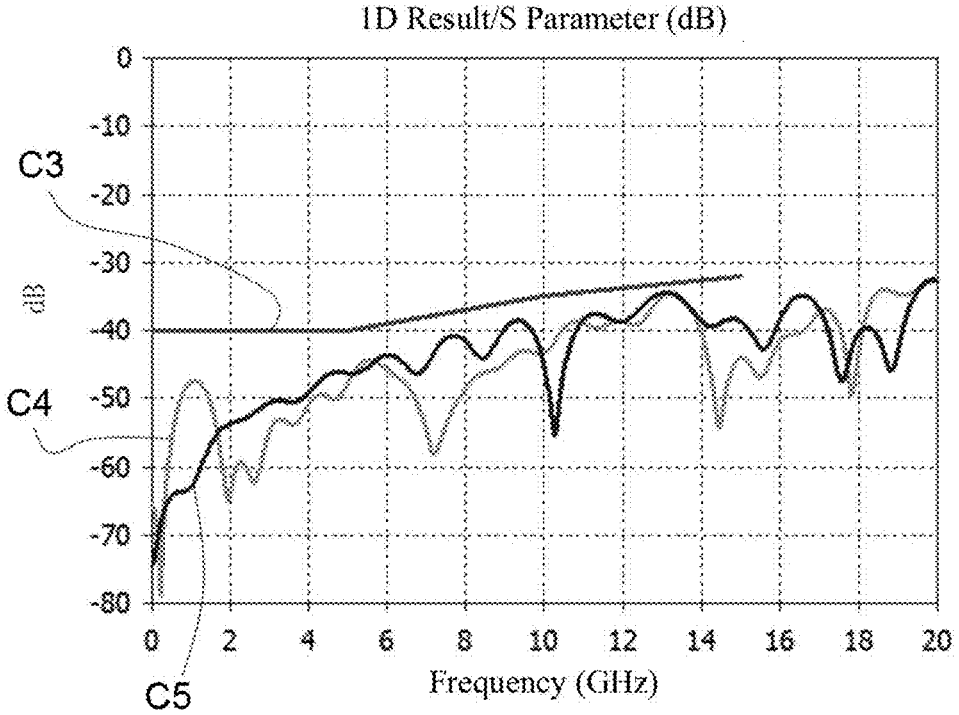
FIG. 8 is a test curve of crosstalk and frequency of conventional electrical connectors and the electrical connector of the present disclosure.

FIG. 8 shows the comparison crosstalk of conventional electrical connectors and the electrical connector of the present disclosure. Curve C3 is a specified crosstalk value, which indicates that the crosstalk could not be higher than the specified value. Curve C4 corresponds to a conventional electrical connector, and curve C5 corresponds to the electrical connector of the present disclosure. An obvious crosstalk occurs at the frequency of 1 GHz for a conventional electrical connector, while the crosstalk at the frequency of 1 GHz is significantly improved as the first bump and the second bump are electrically connected to the first ground terminal and the second ground terminal for the electrical connector of the present disclosure.

In the electrical connector of the present disclosure, by disposing a partitioning member between the plurality of first terminals and the plurality of second terminals, particularly between a pair of first differential signal terminals and a pair of second differential signal terminals, the partitioning member could provide shielding for the pair of first differential signal terminals and the pair of second differential signal terminals. Besides, the partitioning member is electrically connected to the first ground terminal through the first bump. When the electromagnetic waves generated by a pair of first differential signal terminals and a pair of second differential signal terminals during signal transmission is absorbed by the partitioning member, it can be introduced to the ground through the grounding path formed by the electrical connection of the first bump of the partitioning member with the ground terminal to improve the shielding performance of the partitioning member, and preferably to enhance the signal transmission between a pair of first differential signal terminals and a pair of second differential signal terminals.

It is to be understood that the term "comprises", "comprising", or any other variants thereof, is intended to encompass a non-exclusive inclusion, such that a process, method, article, or device of a series of elements not only comprise those elements but further comprises other elements that are not explicitly listed, or elements that are inherent to such a process, method, article, or device. An element defined by the phrase "comprising a . . . " does not exclude the presence of the same element in the process, method, article, or device that comprises the element.

Although the present disclosure has been explained in relation to its preferred embodiment, it does not intend to limit the present disclosure. It will be apparent to those skilled in the art having regard to this present disclosure that other modifications of the exemplary embodiments beyond those embodiments specifically described here may be made without departing from the spirit of the disclosure. Accordingly, such modifications are considered within the scope of the disclosure as limited solely by the appended claims.

What is claimed is:

1. An electrical connector, comprising:

a metal housing comprising a mating interface;

a first insulating base disposed in the metal housing;

a plurality of first terminals disposed at the first insulating base and comprising at least one pair of first differential signal terminals and at least one first ground terminal;

a second insulating base disposed in the metal housing and being assembled to the first insulating base;

a plurality of second terminals disposed at the second insulating base and comprising at least a pair of second differential signal terminals; and a partitioning member disposed between the first insulating base and the second insulating base and between the first terminals and the second terminals, the partitioning member being grounded and comprising a partitioning member body and at least one first bump, the first bump being disposed at the partitioning member body, the partitioning member body being at least disposed between the pair of first differential signal terminals and the pair of second differential signal terminals to shield the pair of first differential signal terminals and the pair of second differential signal terminals, the first bump being electrically connected with the at least one first ground terminal;

wherein the partitioning member further comprises a pair of buckling parts; the buckling parts are respectively connected with two opposite side edges of the partitioning member body and extend toward the mating interface;

wherein the partitioning member further comprises a pair of ground end parts; the pair of ground end parts are respectively connected with two opposite side edges of the partitioning member body and the buckling parts; the pair of ground end parts extend in a direction away from the mating interface;

wherein the first bump is disposed at a position connecting the buckling part, the ground end part, and the partitioning member body.

2. The electrical connector according to claim 1, wherein the partitioning member comprises a first surface and a second surface opposite to the first surface; the first surface corresponds to the first terminals; the second surface corresponds to the second terminals; the first bump protrudes from the first surface.

3. The electrical connector according to claim 2, wherein the second terminals further comprise at least one second ground terminal; the partitioning member further comprises a second bump disposed at the partitioning member body; the second bump protrudes from the second surface and is electrically connected with the at least one second ground terminal.

4. The electrical connector according to claim 2, wherein the first bump is a toothed bump disposed on the first surface and close to a side edge of the partitioning member body; the side edge of the partitioning member body is adjacent to a front edge of the partitioning member body close to the mating interface and a rear edge of the partitioning member body away from the mating interface.

5. The electrical connector according to claim 3, wherein the second bump is a block type bump disposed on the second surface and disposed at the rear edge of the partitioning member body away from the mating interface.

6. The electrical connector according to claim 5, wherein a first recess is formed on a position of the first surface corresponding to the second bump; a second recess is formed on a position of the second surface corresponding to the first bump.

7. The electrical connector according to claim 1, wherein the first insulating base comprises a first through groove; the first bump passes through the first through groove and is in contact with the at least one first ground terminal.

8. The electrical connector according to claim 3, wherein the second insulating base comprises a second through groove; the second bump passes through the second through groove and is in contact with the at least one second ground terminal.

9. The electrical connector according to claim 1, wherein the partitioning member comprises a plurality of mounting holes; the first insulating base comprises a plurality of first engaging columns and a plurality of first engaging holes; the second insulating base comprises a plurality of second engaging columns and a plurality of second engaging holes; the first engaging columns pass through the mounting holes to be engaged with the second engaging holes; the second engaging columns pass through the mounting holes to be engaged with the second engaging holes.

* * * * *